US006769800B1

(12) United States Patent
Young

(10) Patent No.: US 6,769,800 B1
(45) Date of Patent: Aug. 3, 2004

(54) COLLAPSING AND TELESCOPING BAFFLES FOR STIRRED VESSELS

(75) Inventor: Gerald P. Young, Bel Air, MD (US)

(73) Assignee: The United States of America as represented by the Secretary of Army, Washington, DC (US)

( * ) Notice: Subject to any disclaimer, the term of this patent is extended or adjusted under 35 U.S.C. 154(b) by 67 days.

(21) Appl. No.: 10/252,977

(22) Filed: Sep. 23, 2002

(51) Int. Cl.[7] ..... B01F 15/00
(52) U.S. Cl. ..... 366/306; 366/307
(58) Field of Search ..... 366/302, 306–307, 366/336–337, 341; 422/228; 435/304.2

(56) References Cited

U.S. PATENT DOCUMENTS 562,296 A * 6/1896 Haley ..... 366/307
950,152 A * 2/1910 Gaar ..... 366/164.4
975,380 A * 11/1910 Berntson ..... 366/164.4
1,989,019 A * 1/1935 Thomas ..... 366/130
2,064,861 A * 12/1936 Stroud ..... 366/197
3,494,597 A * 2/1970 Rosinger ..... 366/142
4,253,772 A * 3/1981 Burton-Smith ..... 366/130
4,313,680 A * 2/1982 Honnen ..... 366/337
4,494,878 A * 1/1985 Rainey, Jr. ..... 366/341
4,747,696 A * 5/1988 McCrory et al. ..... 366/307
4,829,004 A * 5/1989 Varani et al. ..... 435/304.2
4,880,312 A * 11/1989 Carlson ..... 366/130
5,676,462 A * 10/1997 Fraczek et al. ..... 366/171.1
5,800,058 A * 9/1998 Cook ..... 366/306
D405,813 S * 2/1999 Chesser ..... D15/147

FOREIGN PATENT DOCUMENTS

DE 1944465 * 8/1970
JP 2002-273187 * 9/2002

* cited by examiner

*Primary Examiner*—Charles E. Cooley
(74) *Attorney, Agent, or Firm*—Ulysses John Biffoni

(57) ABSTRACT

A baffle system is provided for insertion into a stirred vessel. In order to be able to be inserted through the relatively narrow orifice at the opening of the vessel, the baffle system is collapsible. Due to the structure of the baffle system, it may be inserted through the narrow orifice and then be manipulated, via articulated joints, such that it rests adjacent to the wider walls of the vessel.

21 Claims, 2 Drawing Sheets

COLLAPSING AND TELESCOPING BAFFLES FOR STIRRED VESSELS

I. BACKGROUND OF THE INVENTION

A. Field of the Invention

The present invention relates to the field of baffles for use in stirred vessels, such as reaction calorimeters. Specifically, the invention is a set of removable baffles, forming a system, which need not be manufactured with the vessel itself. Due to its construction, the baffle system of this invention is removable and replaceable.

B. Background Discussion

Baffles are well known in the art of fluid mixing and enhance stirred vessel, e.g., stirred tank reactor, performance by preventing segregation of liquid of different densities, retard the formation of vortices which lead to poor mixing, and induce well defined axial flow fields within the vessels to ensure good contacting between liquid phases from the top to the bottom of the vessel and prevent spin-up of the fluid in the vessel, so that there will be a large velocity difference between the impeller tip and a fluid element within the flow field.

Reactors for both laboratories and industry have long been equipped with baffles, designed according to well known arts to effect good mixing. Specifically, it is known that the power to mix (p) is proportional to fluid density (ρ), the cube of the impeller rotational speed (N), and the fifth power of the impeller diameter (D), according to the following formula:

$$\rho \propto \rho N^3 D^5 \quad \text{(I)}$$

Additionally, it is known that power (p) varies proportionally to blade number ($B_N$) and blade width ($B_W$) in the turbulent regime according to the following formula:

$$\rho \propto B_N B_W \quad \text{(II)}$$

Baffles are obstructions purposefully placed in the process vessel to redirect flow therein. Baffles, particularly wall baffles, hinder the flow in agitated tanks, to particularly, prevent the fluid from rotating with the impeller. Baffles therefore are generally used to increase the relative velocity between the impeller and the fluid. When the relative difference between impeller speed and baffle speed is maintained high, the result is increased power output, according to Formula I. Accordingly, baffles are used to slow the rotational speed to the fluid without impacting the speed of the impeller. Because the impeller is permitted to rotate unobstructed, and the flow of the fluid is impeded, the rotational speed of the impeller (N) used in Formula I can approximate, if not achieve, its true value. These factors additionally increase and enhance processing capability in the turbulent regime.

Moreover, it is known that baffles prevent the formation of a central vortex which is not effective at mixing. This is due to the fact that when a central vortex is formed, the flow moves in a circular pattern, with little or no axial and/or radial movement, which often leads to separation and classification into small particles. Accordingly, baffles serve as barriers preventing smooth, unobstructed, circular rotation of the fluid in contrast to the movement of the impeller.

Accordingly, stirred vessels, such as reaction calorimeters, have been developed with internal baffles. Specifically, during manufacture, it is possible to form various structures into mixing chamber itself to provide the baffles, as discussed above. However, as many different liquids, having varying densities, are used in the same vessel, and just as many mixing powers are desired with the same vessel, users are forced to acquire varying types of vessels, having different baffle configurations in order to be prepared for the multitude of mixing situations encountered in a typical laboratory or commercial situation.

Although possible, it is not practical to simply insert a set of baffles into a vessel having no baffles manufactured therein. Because many vessels are designed with narrow orifices, only an impeller may be inserted. These vessels are generally designed in a manner, such that they are welded or made with fused glass liners that prevent insertion of rigidly fixed baffles because the rigid baffle system is geometrically too large to pass through the vessel opening or orifice. Therefore, in order to insert a baffle system into an existing vessel, it has been necessary to perform extensive mechanical modifications of expensive vessels that have interior surface finish requirements and jackets for the passage of heat transfer fluids. For example, it is possible to open a sealed vessel, weld or otherwise attached one or more baffle structures to the interior of the opened vessel, and re-seal the vessel. However, the seam created upon re-sealing the vessel may interfere with or otherwise deleteriously effect the internal structure of the vessel. Such seams can provide uneven surfaces or pockets, which prevent complete movement of the fluid. Furthermore, such a procedure requires significant time and expense, and effectively prohibits removal and replacement with a different set of baffles to produce varying turbulent flows.

Therefore, there exists a need in the art for a baffle system which may be added to an existing vessel, without requiring massive mechanical modifications to the vessel structure. Furthermore, the insertable baffle system must fit through the narrow orifice of the vessel which leads to the vessel chamber, without interfering with an impeller or other stirring means.

II. SUMMARY OF THE INVENTION

The invention was developed to solve the problems of the conventional baffle systems. Essentially, the baffle system of the invention includes a pair of rings, attached to a support by a set of linking segments. In order to be easily inserted into a vessel with a narrow orifice, the baffle system has two positions. In the first position, the baffle system is elongated and narrow to pass through the orifice.

Once fully inserted, the baffle system is converted from the first position to a second position. In the second position, the baffle system takes on its operative position, wherein the supports each rest adjacent to the walls of the vessel, and both of the rings are completely inside the chamber.

The present invention, through a unique solution of articulations on baffles, extends the range of many vessels used in the chemical process industry in production facilities, pilot plants and laboratories.

For example, the present invention includes a collapsible baffle system for a stirred vessel having a chamber and an orifice, wherein the orifice is narrower than the chamber, the collapsible baffle system includes a pair of rings; a plurality of supports, connecting the plurality of rings through a plurality of hinged linking segments, wherein at least two, or at least three, sets of at least two, or at least three linked supports are linked in series between the pair of rings. Due to its construction, the baffle system of this invention has a first position, wherein the plurality of linking segments extend axially, with respect to the plurality of rings; and a second position, wherein the plurality of linking segments extend radially with respect to the plurality of rings.

III. BRIEF DESCRIPTION OF THE DRAWINGS

In the present figures, like reference numerals represent like elements.

IV. DETAILED DESCRIPTION OF THE PREFERRED EMBODIMENTS

Figure 1:
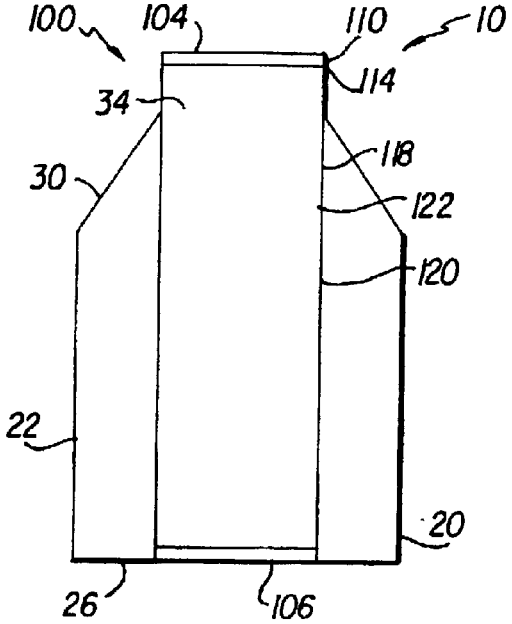
FIG. 1 shows the baffle system of the invention in the first position inserted into a vessel.
Figure 2:
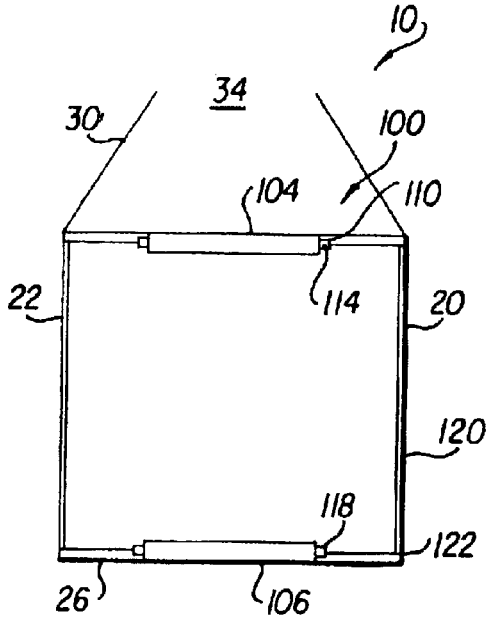
FIG. 2 shows the baffle system in the second position in place in a vessel.

As shown in FIGS. 1 and 2, the present invention is for use with a stirred container 10. Container 10 generally includes a vessel 20 having upright sidewalls 22, a closed bottom 26 and upper walls 30, terminating in an orifice 34. The width of orifice 34 is, typically, less than that of vessel 20, as defined by upper walls 30 and side walls 22, respectively.

Additionally, stirred container 36 includes a stirrer 36 (not shown), as is generally known in the art. Stirrer 36 may simply be an impeller, e.g., an elongated structure on a rotating shaft or any other spinning device. Typically, stirrer 36 is an apparatus centrally disposed in container 36, but not integral with container 36, and extends downward through orifice 34 toward, but typically not completely to, bottom 26. In one embodiment, stirrer 36 is provided as a structure separate from vessel 20, although it is also possible for stirrer 36 to be integral with vessel 20, extending either up through bottom 26 of down from upper walls 30. Stirrer 36 may be of any conventionally known form, such as a turbine, gassing, basket, anchor, helical ribbon and propeller. Vessel 20 may also be provided with any number of additional devices. Such typical devices include heaters, pressure sensors, thermometers, and discharge ports.

Figure 3:
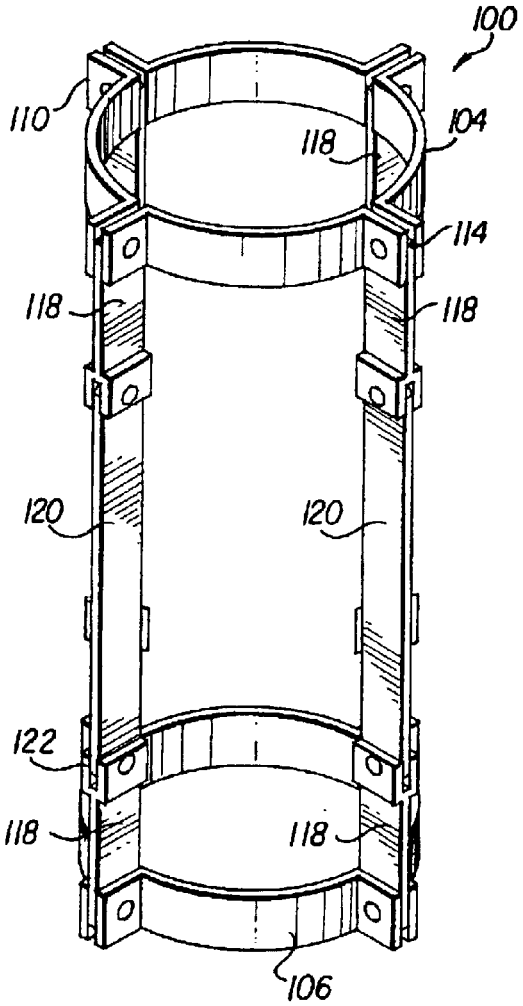
FIG. 3 is a detailed view of the baffle system in the first position, removed from a vessel.

With respect to FIG. 1, a baffle 100 is shown inserted into vessel 20 through orifice 34, in a first, or non-operative position. While FIG. 1 demonstrates the first position for baffle 100 with respect to vessel 20, FIG. 3 is a view of baffle 100 in the first position to show the details of baffle 100.

Specifically, baffle 100 includes an upper ring 104 hingedly connected to a lower ring 106. Both upper ring 104 and lower ring 106 have, along their circumference four ring flanges 110, forming ring hinges 114. To each of ring hinges 114 are hingedly attached a linking segment 118. In the first position, linking segments 118 are situated axially with respect to rings 104, 106. At the end of linking segments 118, opposite ring flanges 110 are supports 120. Supports 120 connect to lower ring 106 via support hinge 122 and another linking segment 118. In the first position, ring flanges 110 on upper ring 104 and lower ring 106, form a straight line, through linking segment 118 and support 120. As a result, baffle 100 is narrow enough to fit through the narrow opening formed by orifice 34 in vessel 20.

The first position of baffle 100 is the non-operating position because baffle 100 is not fully inserted into vessel 20. While lower ring 106 rests on bottom 26 of vessel 20, FIG. 1 shows upper ring 104 extending out of vessel 20. In order to achieve an operational state for baffle 100, it must be altered into a second position.

Figure 4:
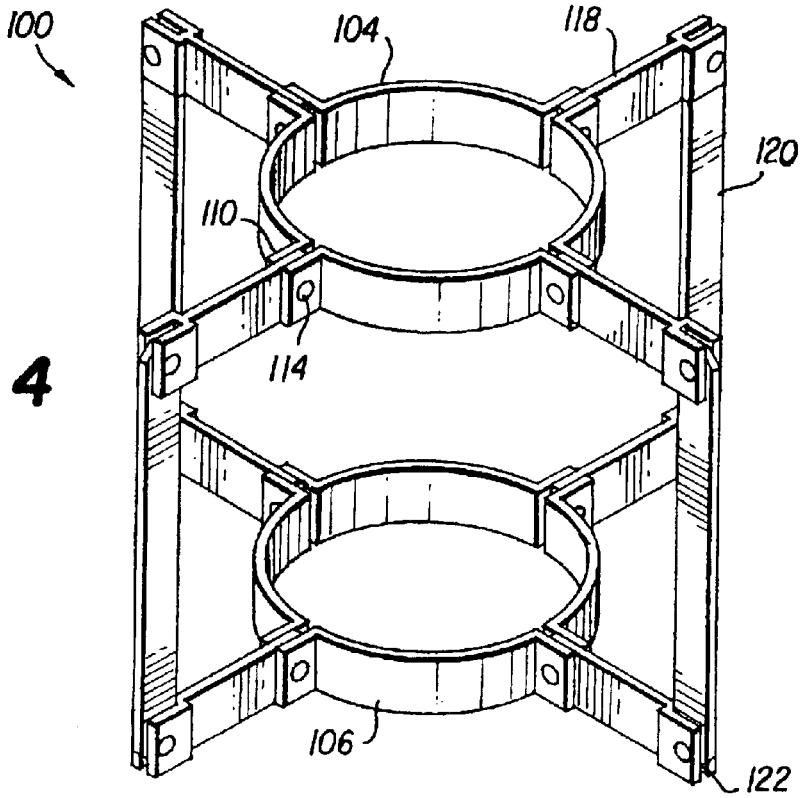
FIG. 4 is a detailed view of the baffle system in the second position, removed from a vessel.

Baffle 100 is shown in the second, or active, position in FIGS. 2 and 4. Specifically, when in the active position, each of rings 104 and 106 are inside vessel 20. In this position, linking segments 118 form right angles with support 120 at support hinges 122. As such, the distance between rings 104, 106 is reduced. The difference in height being equal to twice the length of one linking segment 118, once the length linking segment 118 for each of the two rings 104, 106. Similarly, the distance between supports 120 increases; the increase being equal to the length of one linking segment 118. In one embodiment, each linking segment 118 forms a right angle with support 120 at support hinge 122. However, depending upon the shape of vessel 20 and the design of the baffle 100, any angle may be defined thereby.

Typically, the length of support 120 is approximately equal to the height of a side wall of the vessel. This ensures that when lower ring 106 rests on bottom 26, upper ring 104 will be near the uppermost portion of vessel 20. If linking segments 118 are all of equal length, rings 104 and 106 will be centrally axially located inside vessel 20. However, a shorter length of support 120 may be employed if desired. The length of each linking segment 118 is no longer than one half the difference between the inner diameter of the vessel and the outer diameter of a ring 104 or 106 to have baffle 100 take the position shown in FIGS. 2 and 4.

Figure 3A:
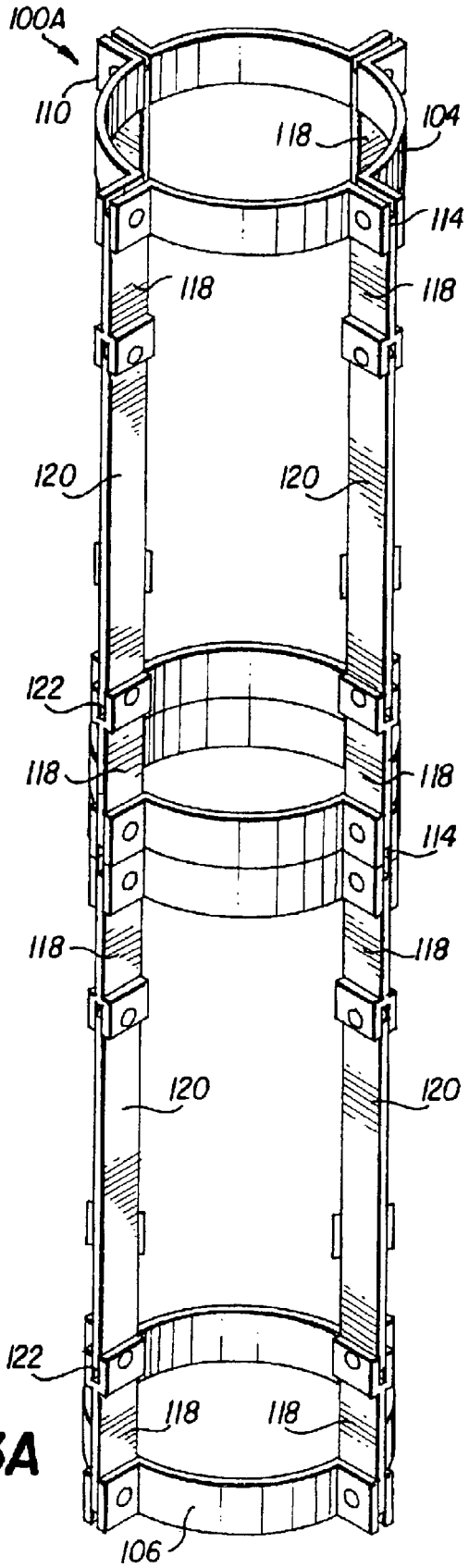
FIG. 3A is a detailed view of a second embodiment of the baffle system in the first position.

Rings 104 and 106 are shown as circular members have a relatively short height However, it is considered within the scope of the invention to modify the shape and/or number of rings 104, 106 as required for various desired results. For example, depending upon the desired power and turbulent effects desired within container 10, rings 104, 106 may be substituted by an another closed polygon, e.g., a triangle, hexagon or solid circle; or a non-closed structure, e.g., rounded or angled U-shape. The only limit to the shape of rings 104 and 106 is the desired effect on the mixing power resulting therefrom. Similarly, the number of rings 104, 106 is shown as two. While this is a typical configuration, it is considered within the scope of the invention to vary the number of rings to achieve any desired power. For example, as shown in FIG. 3*a* which shows a baffle 100A, essentially being constructed of two baffles 100 of FIG. 3 joined, e.g., welded, together.

As shown in the Figures, ring hinge 114 and support hinge 122, at either end of linking segment 118 are simple hinges having a central hinge. However, it is considered within the invention to modify ring hinge 113 and/or support hinge, to form a ball-and-socket joint or any other connection capable of articulating movement such that baffle 100 may be shifted from the first position to the second position. Furthermore, hinges 114, 122 may also be provided with a lock or another securing means to hold baffle 100 in its position.

Container 10 may be any container in which mixing is to occur. Typically, such a container is a reaction calorimeter, such as those of the RC1 series from METTLER TOLEDO GmBH of Im Langacher, Switzerland. Similarly, although presented as being substantially cylindrical, vessel 20 may take on any practical shape, e.g., cube, pyramid, depending upon the desired turbulent effects.

The method of inserting baffle 100 results from its structure. First, baffle 100 is folded to achieve the first position. At ring hinges 114, linking segments 118 are positioned downwardly at right angles to rings 104, 106 into axial alignment with rings 104, 106. Concurrently, at support hinge 122, linking segment 118 is unfolded into a straight alignment, as shown in FIG. 3 As a result, baffle 100 takes on its tall, but narrow first position. Because of the narrow width, baffle 100 may be easily inserted into vessel 20 through orifice 34.

Once lower ring 106 reaches bottom 26 of vessel 20, baffle 100 is unfolded into the second position. Therein, linking segments are positioned radially outward from rings 104, 106. Concurrently, at support hinge 122, linking segment 118 forms a right angle with support 120. As a result, baffle 100 takes on its shorter wider second position. Because of its now wider width, baffle 100 typically extends completely across the width of vessel 20, despite the narrowness of orifice 34. If a lock is provided, it may be engaged to secure baffle 100 in the second positions as to prevent any shifting therefrom.

Although described with reference to preferred embodiments, it should be readily understood that various changes and/or modifications could be made to the invention without departing from the spirit thereof. For example, rings 104, 106 may be of different sizes or shapes. Additionally, supports 120 may also extend only a small portion of the height of vessel 20. Finally, it must be noted that due to the construction of the invention, users are given much flexibility to select and replace baffle structures used in stirred vessels, both easily and inexpensively.

In any event, the invention is only intended to be limited by the scope of the following claims.

I claim:

1. A collapsible baffle system for a stirred vessel having a chamber and an orifice, wherein the orifice is narrower than the chamber, said collapsible baffle system comprising:

a plurality of rings;

a plurality of supports connecting said plurality of rings through a plurality of hinged linking segments;

said baffle system having a first position, wherein said plurality of linking segments extend axially with respect to said plurality of rings, and a second position wherein said plurality of linking segments extend radially with respect to said plurality of rings.

2. The baffle system of claim 1, wherein each of said plurality of linking segments is, at a first end, hingedly connected to one of said supports.

3. The baffle system of claim 2, wherein each of said plurality of linking segments is, at a second end, hingedly connected to one of said plurality of rings.

4. The baffle system of claim 1, wherein each of said plurality of rings is connected to an equal number of said plurality of linking segments.

5. The baffle system of claim 4, wherein said linking segments arm evenly distributed about the periphery of each of said plurality of rings.

6. The baffle system of claim 1, wherein said linking segments are evenly distributed about the periphery of each of said plurality of rings.

7. The baffle system of claim 1, comprising two rings, each of said rings connected to a set of four linking segments; one linking segment of each set of four linking segments connected to a separate support, such that each support is connected to two linking segments.

8. The baffle system of claim 1, wherein when in said first position one of said plurality of rings is at a bottom of the vessel.

9. The baffle system of claim 1, wherein when in said first position one of said plurality of rings is at a bottom of the chamber, and at least one other of said plurality of said rings extends out of said chamber.

10. The baffle system of claim 9, wherein said supports correspond, in length, to the height of the chamber.

11. The baffle system of claim 9, wherein when in said second position each of said plurality of rings is inside the chamber.

12. The baffle system of claim 1, wherein the diameter of each of said plurality of rings is less than that of the orifice of the vessel.

13. The baffle system of claim 12, wherein twice the length of each of said linking segments plus the diameter of each of said plurality of rings is greater than the diameter of the orifice of the vessel.

14. The baffle system of claim 1, wherein said plurality of rings include a plurality of flanges, said flanges evenly distributed about the circumference of said plurality of rings, and said linking segments hingedly connected to said plurality of rings at said plurality of flanges.

15. The baffle system of claim 1, wherein said plurality of supports are connected to said plurality of rings by at least three sets of at least three linked segments.

16. A stirred vessel comprising:

a chamber having a closed end and an open end;

an orifice disposed at said open end of said chamber;

a stirrer disposed inside said chamber; and a collapsible baffle system, removeably disposed inside said chamber, wherein said collapsible baffle system comprises:

a plurality of rings;

a plurality of supports, connecting said plurality of rings through a plurality of hinged linking segments;

said baffle system having a first position, wherein said plurality of linking segments extend axially, with respect to said plurality of rings; and a second position, wherein said plurality of linking segments extend radially with respect to said plurality of rings.

17. The stirred vessel of claim 16, wherein said baffle system comprises two rings, each of said rings connected to a set of four linking segments; one linking segment of each set of four linking segments connected to a separate support, such that each support is connected to two linking segments.

18. The stirred vessel of claim 16, wherein said vessel is a reaction calorimeter.

19. A method of providing a stirred vessel with a removable baffle system, wherein the vessel has a chamber and an orifice, the orifice being narrower than the chamber, and a stirrer; the baffle system having a plurality of rings, and a plurality of supports connecting the plurality of rings through a plurality of hinged linking segments; said method comprising:

inserting the baffle system into the vessel, through the orifice;

adjusting said baffle system into a first position, wherein one of said plurality of rings is at the bottom of said vessel and at least one other of said plurality of rings is disposed outside said vessel; and manipulating said baffle system into a second position, wherein each of said plurality of rings is disposed inside said vessel.

20. The method of claim 19, wherein said adjusting is performed prior to said inserting.

21. The method of claim 19, wherein the baffle system comprises two rings, each of said rings connected to a set of four linking segments, one linking segment of each set of four linking segments connected to a separate support, such that each support is connected to two linking segments.

* * * * *